US008262811B2

(12) United States Patent
Capper et al.

(10) Patent No.: US 8,262,811 B2
(45) Date of Patent: Sep. 11, 2012

(54) AQUEOUS REACTION SOLUTION AND METHOD OF PASSIVATING WORKPIECES HAVING ZINC OR ZINC ALLOY SURFACES AND USE OF A HETEROAROMATIC COMPOUND

(75) Inventors: Lee Capper, Wolverhampton (GB); Andreas Noack, Berlin (DE)

(73) Assignee: Atotech Deutschland GmbH, Berlin (DE)

( * ) Notice: Subject to any disclaimer, the term of this patent is extended or adjusted under 35 U.S.C. 154(b) by 877 days.

(21) Appl. No.: 12/086,796

(22) PCT Filed: Jan. 23, 2007

(86) PCT No.: PCT/EP2007/000805

§ 371 (c)(1),
(2), (4) Date: Jun. 19, 2008

(87) PCT Pub. No.: WO2007/088030

PCT Pub. Date: Aug. 9, 2007

(65) Prior Publication Data

US 2009/0032146 A1 Feb. 5, 2009

(30) Foreign Application Priority Data

Jan. 31, 2006 (EP) ..... 06001930

(51) Int. Cl.
*C23C 22/30* (2006.01)
*C23C 22/48* (2006.01)

(52) U.S. Cl. ..... 148/267; 148/240; 148/243; 148/274; 106/14.05; 106/14.11

(58) Field of Classification Search ..... 148/267, 148/240, 243, 274; 106/14.05, 14.11
See application file for complete search history.

(56) References Cited

U.S. PATENT DOCUMENTS

| | | | | |
|---|---|---|---|---|
| 3,993,548 | A | 11/1976 | Creutz et al. | |
| 4,359,348 | A | 11/1982 | Crotty | |
| 4,384,902 | A | 5/1983 | Crotty et al. | |
| 4,578,122 | A * | 3/1986 | Crotty | 148/267 |
| 5,328,526 | A * | 7/1994 | Jo et al. | 148/260 |
| 6,068,711 | A * | 5/2000 | Lu et al. | 148/273 |
| 6,190,780 | B1 * | 2/2001 | Shoji et al. | 428/472 |
| 6,200,672 | B1 | 3/2001 | Tadokoro et al. | |
| 6,287,704 | B1 | 9/2001 | Preikschat et al. | |
| 6,946,201 | B2 | 9/2005 | Preikschat et al. | |
| 7,314,671 | B1 | 1/2008 | Preikschat et al. | |
| 2003/0145909 | A1 | 8/2003 | Diaddario et al. | |
| 2003/0207133 | A1 | 11/2003 | Preikschat et al. | |
| 2003/0234063 | A1 | 12/2003 | Sturgill et al. | |

FOREIGN PATENT DOCUMENTS

| | | | |
|---|---|---|---|
| DE | 4135524 | A1 | 10/1991 |
| DE | 19615664 | A1 | 10/1997 |
| DE | 10305449 | A1 | 8/2004 |
| GB | A 2097024 | | 4/1982 |

OTHER PUBLICATIONS

Philippe, L. et al. "Electroplating of Stainless Steel", Chem. Mater. 2008, 20, 3377-3384.*

Merrill and Spencer in "Some Quaternary Ammonium Silicates", Journal of Physical and Colloid Chemistry, 55, 187 (1951).

* cited by examiner

*Primary Examiner* — Lois Zheng

(74) *Attorney, Agent, or Firm* — Frank J. Bonini, Jr.; John F. A. Earley, III; Harding, Earley, Follmer & Frailey, P.C.

(57) ABSTRACT

For producing corrosion resistant yellow passivate layers on zinc and zinc alloy surfaces, an aqueous reaction solution is utilized that contains trivalent chromium ions, at least one acid as well as at least one heteroaromatic compound selected from the group comprising nicotinic acid, the salts and derivatives thereof.

16 Claims, No Drawings

AQUEOUS REACTION SOLUTION AND METHOD OF PASSIVATING WORKPIECES HAVING ZINC OR ZINC ALLOY SURFACES AND USE OF A HETEROAROMATIC COMPOUND

DESCRIPTION OF THE INVENTION

The present invention relates to an aqueous reaction solution and to a method of passivating workpieces having zinc or zinc alloy surfaces as well as to the use of a heteroaromatic compound, said compound being selected from the group comprising nicotinic acid, the salts and derivatives thereof, for producing colored passivate layers on zinc and zinc alloy surfaces.

BACKGROUND ART

Metallic materials, more specifically iron and steel, are zinc-plated or cadmium-plated to protect them from corrosive environmental factors. The corrosion protection of zinc is due to the fact that it is even less precious than the base metal so that it first attracts all of the corrosive attack, thus acting as a sacrificial layer. The base metal of the zinc-plated component of concern remains intact as long as it remains completely covered with zinc, with the mechanical functionality being preserved longer than with parts that have not been zinc-plated. Thick zinc layers provide of course higher corrosion protection than thin layers—the corrosive removal of thicker layers taking longer.

Corrosive attack of the zinc layer may be heavily delayed by chromating so that corrosion of the base metal also is delayed further than with mere zinc-plating. Corrosion protection through the layer system zinc/chromating is much better than the one provided by a zinc layer that only has the same thickness. Further, chromating also defers optical erosion of a component part through environmental factors—the corrosion products of zinc, the so-called white rust, also affect the appearance of a component.

The advantages of chromating are so important that almost any galvanically zinc-plated surface is additionally chromated. Prior art knows of four chromating processes named by their colors and applied through processing (immersion, spraying, rolling) a zinc-coated surface with the corresponding aqueous chromating solution. Further, yellow and green chromatings, which are produced in an analogous manner, are known for aluminium. At any rate, the layers have different thicknesses and are substantially made from amorphous zinc/chromium oxide (or aluminium/chromium oxide) of a nonstoichiometric composition, a certain water content and incorporated foreign ions. The following chromating processes are known and classified in process groups according to DIN 50960, part 1:

1) Colorless and Blue Chromatings, Groups A and B:

The blue chromating layer is up to 80 nm thick, slightly blue in itself and has, depending on the layer thickness, a golden, reddish, bluish, greenish or yellow iridescent color produced by light refraction. Very thin chromate layers hardly having any color of their own are classified as colorless chromatings (group A). In both cases, the chromating solution may consist both of hexavalent and of trivalent chromates as well as of mixtures thereof, further of support electrolytes and of mineral acids. There are variants with fluoride and some without fluoride. The chromating solutions are used at room temperature. Corrosion protection of intact blue chromatings (group B) amounts to 10-40 h in the salt spray cabinet according to DIN 50021 SS before the first corrosion products appear. The minimum requirement for the process groups A and B according to DIN 50961, chapter 10, Table 3, is 8 h for workpieces placed in drums and 16 h for workpieces placed on racks.

2) Yellow Chromatings, Group C:

The yellow chromating layer is about 0.25-1 μm thick, dyed golden yellow and often highly purple-green iridescent. The chromating solution substantially consists of water-dissolved hexavalent chromates, support electrolytes and mineral acids. The yellow color is due to the significant fraction (80-220 mg/m$^2$) of hexavalent chromium that is incorporated in addition to the trivalent chromium generated by reduction during the layer formation reaction. The chromating solutions are used at room temperature. Corrosion protection of intact yellow chromatings amounts to 100-200 h in the salt spray cabinet according to DIN 50021 SS before the first corrosion products appear. The minimum requirement for the Process Group C according to DIN 50961, chapter 10, Table 3, is of 72 h for workpieces placed in drums and 96 h for workpieces placed on racks.

3) Olive Chromating, Group D:

The typical olive chromating layer is of up to 1.5 μm thick, and is olive green to olive brown allover. The chromating solution substantially consists of water-dissolved hexavalent chromates, support electrolytes and mineral acids, more specifically of phosphates or phosphoric acid, and may also contain formates. Considerable amounts of chromium(VI) (300-400 mg/m$^2$) are incorporated into the layer. The chromating solutions are used at room temperature. Corrosion protection of intact olive chromatings amounts to 200-400 h in the salt spray cabinet according to DIN 50021 SS before the first corrosion products appear. The minimum requirement for the Process Group D according to DIN 50961, chapter 10, Table 3, is of 72 h for workpieces placed in drums and 120 h for workpieces placed on racks.

4) Black Chromatings, Group F:

The black chromating layer basically is a yellow or olive chromating in which colloidal silver is incorporated as a pigment. The chromating solutions approximately have the same composition as yellow or olive chromatings and additionally contain silver ions. If the composition of the chromating solution is appropriate, iron, nickel or cobalt oxide incorporates into the chromate layer on zinc alloy layers such as Zn/Fe, Zn/Ni or Zn/Co as a black pigment so that silver is not necessary in this case. Considerable amounts of chromium(VI) are incorporated into the chromate layers in amounts of between 80 and 400 mg/m$^2$, depending on whether the basis is a yellow or an olive chromating. The chromating solutions are used at room temperature. Corrosion protection of intact black chromatings on zinc amounts to 50-150 h in the salt spray cabinet according to DIN 50021 SS before the first corrosion products appear. The minimum requirement for the Process Group F according to DIN 50961, chapter 10, Table 3, is of 24 h for workpieces placed in drums and 48 h for workpieces placed on racks. Black chromatings on zinc alloys have considerably higher values than those mentioned.

5) Green Chromatings for Aluminium, Group E:

According to prior art, thick chromate layers with high corrosion protection >100 h in the salt spray cabinet according to DIN 50021 SS or ASTM 117-73 before the first corrosion products appear according to DIN 50961 (June 1987) chapter 10, more specifically chapter 10.2.1.2, may be manufactured without sealing and without any other particular post-treatment (DIN 50961, chapter 9), only by treatment with dissolved, markedly toxic chromium(VI) compounds. Accordingly, the chromate layers with the requirements mentioned placed on corrosion protection still contain these markedly toxic and carcinogenic chromium(VI) compounds that, in addition thereto, are not completely immobilized in the layer. Chromating with chromium(VI) compounds is problematic with regards to occupational safety and health. The use of zinc-plated chromatings made with chromium(VI) compounds, such as the widely used yellow chromatings on screws for example, constitutes a potential risk for the population and generally increases the risk of cancer.

Therefore, passivation methods obviating in part or in whole the use of chromium(VI) compounds are described in prior art.

U.S. Pat. No. 4,384,902 describes, with the examples 1, 2, 4 and 5 in particular, passivate layers meeting the requirements in the salt spray test. In all cases, the layer contains cerium having a yellowish coloration emphasized by the Ce(IV) ion. In the bath solution, the examples only contain Ce(III) and hydrogen peroxide as the oxidizing agent. The description discusses the fact that, under acid conditions, hydrogen peroxide does not act as an oxidizing agent for Ce(III), but that the surface pH increases so much during deposition for a sufficient amount of Ce(IV) to be generated. The yellowish color achieved with the bath composition described is indeed indicative of an oxidation, but only of an oxidation of Ce(III) to Ce(IV). Tetravalent cerium is a more efficient oxidizing agent than hexavalent chromium, this being the reason why Ce(IV) will produce Cr(VI) from Cr(III), which is to be avoided. Cr(VI) has a very strong yellow color and is known as a corrosion protection agent. Accordingly, the layer described in U.S. Pat. No. 4,384,902 is not free of hexavalent chromium.

U.S. Pat. No. 4,359,348 also describes passivate layers meeting the above mentioned requirements in the salt spray test. Again, in all the cases, the layer contains cerium having a yellowish coloration emphasized by the Ce(IV) ion. Therefore, this document does not go beyond U.S. Pat. No. 4,384,902.

Further, U.S patent application Ser.No. 2003/00234063 A1 discloses non-toxic corrosion-protection conversion coatings based on cobalt. These conversion coatings are described to be suitable for zinc substrates for example. The conversion coatings may, inter alia, contain Cr(III) ions and nicotinic acid.

Moreover U.S. Pat. No. 6,190,780 B1 discloses a surface treated metal material with corrosion-resistant coating layers. The metal material may be fused zinc-plated steel sheets. The conversion coating may contain $Cr(OH)_3$ and nicotinic acid.

Further, GB-A-2 097 024 discloses the treatment of metal surfaces for improving corrosion protection on zinc and zinc alloy surfaces with an aqueous acidic solution containing an oxidizing agent and at least one metal, selected from the group consisting of iron, cobalt, nickel, molybdenum, manganese, aluminium, lanthanum, lanthanide mixtures or cerium ions or mixtures thereof and more specifically iron and cobalt ions. Further, GB-A-2 097 024 discloses the use of trivalent chromium ions and iron ions in combination with an additional metal, selected from the group consisting of the above mentioned ions or cerium ions, combinations of chromium(III) in combination with an oxidizing agent and cerium or lanthanum ions being mainly described though.

DE 196 15 664 A1 describes a method of producing chromium(VI)-free passivate layers having a greater layer thickness and increased corrosion protection. Organic chelate ligands, more specifically dicarboxylic acids, tricarbonic acids and hydroxycarboxylic acids such as oxalic acid, malonic acid, succinic acid, glutaric acid, adipinic acid, pimelic acid, suberic acid, azelaic acid, sebacinic acid, maleic acid, phthalic acid, terephthalic acid, ascorbic acid, malic acid, tartaric acid or citric acid, are thereby added to the reaction solution. These chelate ligands form complexes with chromium(III) having poor kinetic stability and quickly liberating said chromium which incorporates at high reaction speed into the growing ZnCrO layer. Metal ions such as bivalent cobalt ions in the form of soluble salts are added as an additional catalyst for increasing reaction speed and thickness growth of the chromate layer. The thus produced passivate layers do not contain any chromium(IV) and allow for corrosion protection of up to more than 100 h, which corresponds approximately to that of a conventional yellow chromating. The thus produced chromate layers have a greenish, purple-green iridescent color. An alternative method of passivation described in DE 41 35 524 A1, which relies on a chromium(III) oxalate complex, forms a blue passivate film.

DE 103 05 449 A1 describes a mixture of substances and a method of producing colored passivate layers, each of them relying on a combination of a reaction solution containing chromium(III) ions and of a quinoline dye. The disadvantage thereof is the poor stability of the quinoline dye both in the reaction solution and in the passivate layer. This is due, inter alia, to the lack of UV stability of such compounds.

The examples mentioned herein above show that chromium(III) passivations still only allow for restricted application. In addition to the often poor corrosion protection with blue chromatings and the risk of chromium(VI) residues, there also is the disadvantage that the possibilities of obtaining a coloring with chromium(III) passivations are limited. The colors obtained through chromium(III) passivation are substantially limited to blue and greenish layers of chromate, whilst yellow chromatings on the basis of chromium(III) will not allow to impart a uniform, strong yellow color, resulting instead in light, markedly iridescent coatings or to coatings tending to be bluish or greenish.

Repeated attempts have been made to produce yellow passivation layers only having a small chromium(VI) fraction or having no chromium(VI) at all. The intensive yellow color in conventional yellow chromatings is imparted by the very chromium(VI).

It is therefore an object of the present invention to provide a solution of producing passivate layers on a substrate, the solution containing chromium(III) but no chromium(VI).

It is another object of the present invention to provide a solution of producing passivate layers on a substrate, the layers being color intensive and durably stable yellow.

It is still another object of the present invention to provide a solution of producing passivate layers on a substrate, the layers being suitable to prevent corrosion of the substrate.

It is still another object of the present invention to provide a method of producing passivate layers on a substrate, the layers containing hardly any chromium(VI), being color intensive, durably stable yellow and being suitable to prevent corrosion of the substrate.

SUMMARY OF THE INVENTION

These objects are achieved by the aqueous reaction solution, by the method of passivating surfaces of workpieces comprising zinc and zinc alloy surfaces, as well as by the use of a heteroaromatic compound selected from the group comprising nicotinic acid, the salts and derivatives thereof, for producing colored passivate layers on zinc and zinc alloy surfaces.

The invention is more specifically suited for producing yellow passivate layers having hardly any chromium(VI) on zinc and zinc alloy surfaces. The effect of the yellow passivation treatment is obtained, in accordance with the present invention, by an aqueous reaction solution containing chromium(III) ions, at least one acid as well as at least one heteroaromatic compound selected from the group comprising nicotinic acid, the salts and derivatives thereof. Stable chemical compositions for passivating zinc and zinc alloy surfaces are obtained adding the heteroaromatic compounds. Nicotinic acid is used as the preferred heteroaromatic compound. Instead of the free acid, the salts thereof, the sodium or potassium salt in particular, may be utilized. This will enable the acid to dissolve more readily in aqueous solutions.

DETAILED DESCRIPTION OF THE INVENTION

Advantageous concentrations of the heteroaromatic acids strongly depend on the desired color intensity of the yellow passivation and may generally be at least $4\cdot10^{-3}$ mol/l (corresponds to 0.5 g/l if nicotinic acid is used), more specifically at least $10^{-2}$ Mol/l (corresponds to 1.25 g/l if nicotinic acid is used), even more specifically $5\cdot10^{-2}$ Mol/l (corresponds to 6.2 g/l if nicotinic acid is used) and most preferred $8\cdot10^{-2}$ Mol/l (corresponds to 10 g/l if nicotinic acid is used). The upper concentration limit may be $325\cdot10^{-3}$ Mol/l (corresponds to 40 g/l if nicotinic acid is used), preferably $240\cdot10^{-3}$ Mol/l (corresponds to 30 g/l if nicotinic acid is used) and most preferably $175\cdot10^{-3}$ Mol/l (corresponds to 22 g/l if nicotinic acid is used). A preferred concentration of the heteroaromatic compounds is at least 5 g/l, more preferably 10 g/l, even more preferably at least 15 g/l. The concentration of these compounds will preferably not exceed 30 g/l, more preferably 20 g/l. It generally applies that the yellow color is all the more intensive the higher the content of nicotinic acid. At a concentration in excess of 20 g/l of nicotinic acid, the increase in color intensity observed was negligible. Insofar as the afore mentioned concentration limits (in [g/l]) are converted into mol/l, they also apply for the salts of the nicotinic acid and for the derivatives thereof.

The yellow color is of great practical use because it serves to distinguish workpieces in processing parts produced on a large scale, such as in the automotive industry. Purposeful dying with the composition of the invention allows for example to reliably and readily distinguish right-handed component parts from left-handed ones for example. This tremendously increases process safety, in particular when processing large numbers of very similar parts.

The layer of the invention however is produced without oxidizing agent and therefore does not contain any hexavalent chromium. Workpieces provided with such layers have very high corrosion resistance comparable to that of a zinc-plated surface provided with a yellow chromating or even better than that.

The pH of the reaction solution used for carrying out this method may for example be at least 1.5, preferably at least 1.8. The upper pH limit may be 3.0, preferably 2.2. The desired pH may be produced adding hydrogen ions, meaning adding the at least one acid, preferably nitric acid or another mineral or carboxylic acid, and may then be precisely adjusted using a caustic soda solution.

The concentration of the dissolved chromium(III) ions may be at least 0.2 g/l, preferably at least 1 g/l. It may range to up to 30 g/l, preferably to up to 5 g/l. In principle, the chromium(III) compounds may also be contained in the reaction solution in a concentration up to the saturation limit. Chromium chloride ($CrCl_3$), chromium nitrate ($Cr(NO_3)_3$), chromium sulfate ($Cr_2(SO_4)_3$) or another water soluble chromium(III) salt may be used as the source for the chromium (III) ions.

Bi- to hexavalent metal ions of at least one element such as of aluminium, cobalt, nickel, iron, gallium, indium, the lanthanides, zirconium, scandium, titanium, vanadium, chromium, manganese, copper, zinc, yttrium, niobium, molybdenum, hafnium, tantalum and tungsten may be used as the catalysts in the reaction solution. These metal ions may be added to the reaction solution in the form of soluble salts, preferably as nitrates, sulfates or halides. In a preferred embodiment, cobalt(II) ions are contained in a concentration of at least about 0.1 g/l. The concentration thereof may preferably reach up to 5 g/l. Aqueous or nonaqueous cobalt nitrates ($Co(NO_3)_2$), cobalt sulfates ($CoSO_4$) or cobalt chloride ($CoCl_2$) are examples of suitable cobalt(II) sources.

Further, the chemical composition may contain at least one acid-stable, water soluble silicate for improving the passivating properties and for providing the passivate layer with increased hardness. Preferably, the concentration is at least 0.5 g/l. The upper concentration limit preferably is 10 g/l. Each of these concentration values is based on $SiO_2$. Usable silicates may be both inorganic and organic as long as they are soluble in the reaction solution. Organic silicates are to be preferred because of their stabilizing property with regard to the lifetime of the bath. Usable inorganic silicates may be acid-stable colloidal solutions of silicon dioxide. Organic silicates may also be utilized. Such type silicates may be tetramethylammonium silicate, phenyltrimethyl ammonium silicate, phenyltrimethyl ammonium disilicate and phenyltrimethyl ammonium trisilicate as well as benzyltrimethyl ammonium silicate and benzyltrimethyl ammonium disilicate. Organic silicates having the general chemical formula $ROR':xSiO_2:yH_2O$ are suited, wherein R is a quaternary ammonium radical that is substituted with four organic residues which are selected from the group comprising alkyl, alkylene, alkanol, aryl, aralkyl and mixtures thereof, wherein R' is either R or hydrogen and wherein x=1-3 and y=0-15. Such type organic silicates may be synthesized using current chemical methods. Synthesis methods have been described by Merrill and Spencer in "Some Quaternary Ammonium Silicates", *Journal of Physical and Colloid Chemistry,* 55, 187 (1951) as well as in U.S. Pat. No. 3,993,548 for example.

The reaction solution may contain halides, more specifically chloride and fluoride, sulfate ions, nitrate ions, phosphoric acid, phosphoric acid ester or phosphate ions, silicate ions, silicic acids, amino acids, amines and surfactants as further components or supportions. Suited surfactants are for example aliphatic fluorocarbon sulfonates such as the products Fluorad® of 3M Comp., US, for example Fluorad® FC 98. Additionally, complexing agents for chromium(III) ions such as malonic acid and oxalic acid, may be contained therein.

Using the reaction solution of the invention, workpieces with surfaces made of zinc or zinc alloys preferably may be provided with a passivate layer. Both workpieces provided with a zinc coating produced by alkaline, cyanidic or by acid, non-cyanidic electrolytic zinc deposition and workpieces that are zinc-coated by means of a melt or that are themselves made from zinc or a zinc alloy are passivatable therewith. Zinc alloys on the workpiece surfaces may for example be Zn/Fe, Zn/Ni and Zn/Co alloys. Further, such workpieces may be treated with the reaction solution in the manner taught by the invention that have, in addition to the zinc or zinc alloy surfaces, exposed surfaces that are not made from zinc or zinc alloy, for example surfaces containing iron such as steel surfaces. These additional surfaces may be passivated together with the zinc or zinc alloy surfaces. In principle, there also is the possibility of using the reaction solution of the invention for passivating aluminium surfaces, aluminium alloy surfaces as well as surfaces made from cadmium.

The passivation method comprises contacting the workpieces having zinc or zinc alloy surfaces with the reaction solution. The reaction is preferably run at a temperature from at least about 10° C. The maximum bath temperature may for example be 80° C. A particularly preferred bath temperature ranges from 30° C. to 50° C.

The workpieces may preferably be contacted with the reaction solution by immersion, meaning the workpieces are dipped into the reaction solution contained in a tank. For this purpose, the workpieces may either be retained on racks and be immersed into the reaction solution together therewith or be located in a drum or on a tray and immersed into the reaction solution together with said drum or tray. In an alternative procedure, the workpieces are contacted with the reaction solution through spray immersion. In another way of proceeding, the workpieces are contacted with the reaction solution by spraying. The workpieces may also be splashed with the reaction solution, for example by means of a nozzle through which the flow of reaction solution exits. Another way of treating the workpieces is to apply the reaction solution by daubing, rolling or any other application technique onto the workpiece surfaces. The treatment may occur in conventional lines in which the workpieces are treated in batches or in horizontal conveyorized lines through which the workpieces are passed continuously and are treated thereby.

If the workpieces are treated by immersion in the reaction solution, the processing time may range from 20 to 200 s; in a preferred embodiment, it ranges from about 30 s to approximately 90 s. Depending on the technique used for contacting the workpieces with the reaction solution, longer or shorter processing times may be necessary.

For performing the passivation of the invention, the workpieces are at need cleaned prior to bringing them into contact with the reaction solution. This however may be obviated if the workpieces are contacted with the reaction solution immediately after having been electrolytically zinc-plated and after the zinc-plating solution has been rinsed off thereafter. Upon completion of the passivation method of the invention, the workpieces are preferably dried, for example with hot air. Additionally, the workpieces may also be rinsed prior to drying in order to remove excess reaction solution from the surface.

The following examples serve to further explain the invention:

EXAMPLES

Example 1

A reaction solution having the following composition was prepared:

2 g/l of Cr(III) as chromium nitrate
1.5 g/l of ammonium hydrogen fluoride
1 ml/l nitric acid (conc.)
10 g/l nicotinic acid as the sodium salt thereof
in water The pH of the reaction solution was adjusted with nitric acid or caustic soda to a pH of 2.0. The solution was heated to 45° C. Zinc-plated parts held on a rack were immersed for 60 seconds into the reaction solution, and then rinsed and dried. The resulting passivate layer had a uniform yellow-green iridescent coloration. Its corrosion resistance according to DIN 50021 SS was determined to be approximately 72 h before the first signs of white rust appeared.

Example 2

The test described in Example 1 was repeated, with 0.5 g/l of cobalt(II) nitrate being additionally added to the solution. The corrosion resistance of the layer according to DIN 50021 SS was determined to be 96 h before white rust appeared.

Example 3

The test described in Example 1 was repeated, with the following modified composition:

3 g/l of Cr(III) as chromium nitrate
2 g/l of sodium fluoride
1 ml/l of nitric acid (conc.)
1 g/l of malonic acid
5 g/l of nicotinic acid as the sodium salt thereof
in water The resulting passivate layer had a uniform yellow-green iridescent coloration. Its corrosion resistance according to DIN 50021 SS was determined to be about 96 h before white rust first appeared.

It is understood that the examples and embodiments described herein are for illustrative purpose only and that various modifications and changes in light thereof as well as combinations of features described in this application will be suggested to persons skilled in the art and are to be included within the spirit and purview of the described invention and within the scope of the appended claims. All publications, patents and patent applications cited herein are hereby incorporated by reference.

The invention claimed is:

1. An aqueous reaction solution for passivating workpieces having zinc or zinc alloy surfaces, containing trivalent chromium ions, at least one acid, and at least one heteroaromatic compound selected from the group consisting of nicotinic acid, the salts and derivatives thereof, wherein the concentration of the trivalent chromium ions is from about 0.2 to about 30 g/l, wherein the concentration of the at least one heteroaromatic compound is in a range from about $4 \cdot 10^{-3}$ Mol/L to about $325 \cdot 10^{-3}$ Mol/L, and wherein the aqueous reaction solution forms a passivation layer on the workpieces based on Cr(III).

2. The aqueous reaction solution as set forth in claim 1, characterized in that the salt of the nicotinic acid is a sodium salt.

3. The aqueous reaction solution of claim 1, characterized in that the concentration of the nicotinic acid in the reaction solution is from about 0.5 to about 30 g/l.

4. The aqueous reaction solution of claim 1, characterized in that the concentration of the nicotinic acid in the reaction solution is from about 10 to about 20 g/l.

5. The aqueous reaction solution of claim 1, characterized in that the concentration of the trivalent chromium ions is from about 1 to about 5 g/l.

6. The aqueous reaction solution of claim 1, characterized in that the reaction solution additionally contains as a catalyst bi- to hexavalent metal ions of at least one element selected from the group consisting of Al, Co, Ni, Fe, Ga, In, lanthanides, Zr, Sc, Ti, V, Cr, Mn, Cu, Zn, Y, Nb, Mo, Hf, Ta and W.

7. The aqueous reaction solution of claim 1, characterized in that the reaction solution additionally contains as a catalyst cobalt(II) ions in a concentration of from about 0.1 to about 5 g/l.

8. The aqueous reaction solution of claim 1, characterized in that the at least one acid is selected from the group consisting of nitric acid, hydrochloric acid and sulfuric acid.

9. The aqueous reaction solution as set forth in claim 8, characterized in that the reaction solution contains at least one halide ion source.

10. The aqueous reaction solution of claim 1, characterized in that the reaction solution additionally contains at least one acid-stable water soluble silicate compound.

11. The aqueous reaction solution of claim 1, characterized in that the reaction solution contains at least one fluoride ion source.

12. A method of passivating workpieces having zinc or zinc alloy surfaces comprising contacting the workpieces with the aqueous reaction solution of claim 1, thereby forming a passivation layer based on Cr(III) thereon.

13. The method of claim 12, characterized in that the workpieces are contacted with the aqueous reaction solution at a reaction temperature ranging from about 10° C. to about 80° C.

14. The method of claim 12, characterized in that the workpieces are contacted with the aqueous reaction solution at a reaction temperature ranging from about 30° C. to about 50° C.

15. The method of claim 12, characterized in that the workpieces are contacted with the aqueous reaction solution by immersion for about 20 to about 200 seconds.

16. The method of claim 12, characterized in that the workpieces are contacted with the aqueous reaction solution by immersion for about 30 to about 90 seconds.

* * * * *